US005110699A

United States Patent [19]

May et al.

[11] Patent Number: 5,110,699

[45] Date of Patent: May 5, 1992

[54] METHOD AND APPARATUS FOR FORMING MASTERS AND IMAGES THEREFROM

[75] Inventors: John W. May; William Mey; Susan E. Riblett, all of Rochester, N.Y.

[73] Assignee: Eastman Kodak Company, Rochester, N.Y.

[21] Appl. No.: 459,850

[22] Filed: Jan. 2, 1990

[51] Int. Cl.[5] ..... G03G 13/00; G03G 13/28

[52] U.S. Cl. ..... 430/54; 430/49; 430/51

[58] Field of Search ..... 430/54, 31, 49, 51

[56] References Cited

U.S. PATENT DOCUMENTS 4,429,027 1/1984 Chambers et al. ..... 430/126 X 4,793,255 12/1988 Bujese et al. ..... 430/33

*Primary Examiner*—Marion E. McCamish

*Assistant Examiner*—Stephen C. Crossan

*Attorney, Agent, or Firm*—Leonard W. Treash, Jr.

[57] ABSTRACT

Xeroprinting masters are formed by first forming a toner mask. The mask is used to expose a xeroprinting master material exhibiting persistent conductivity in response to a given wavelength and intensity of radiation. The toner mask can be formed and transferred to the xeroprinting material without fusing. After exposure the masking toner can be cleaned off providing a planographic master. Multicolor images are formed by forming two or more masking images, and transferring them to two or more master surfaces. After irradiation and cleaning each master surface is used as a xeroprinting master for a particular color in a multicolor duplicating system.

12 Claims, 7 Drawing Sheets 201
202
203
204
205
210
211
219
222
223
224
225
226
229
231

2
10
11
12
15
16
20
21
22
29
32
33
35
3
45
4
55
5
51
65
6
70
71

METHOD AND APPARATUS FOR FORMING MASTERS AND IMAGES THEREFROM

RELATED APPLICATIONS

This application is related to co-assigned:

U.S. patent application Ser. No. 07/459,906, filed Jan. 2, 1990, METHOD AND APPARATUS FOR FORMING MULTICOLOR IMAGES, Alan E. Rapkin; and U.S. patent application Ser. No. 07,459,851, filed Jan. 2, 1990, MULTICOLOR IMAGE FORMING APPARATUS HAVING IMPROVED REGISTRATION, Alan E. Rapkin.

TECHNICAL FIELD OF THE INVENTION

This invention relates to the formation of masters and to the formation of images with those masters, for example, multicolor images.

BACKGROUND ART

U.S. Pat. No. 4,661,429 to Molaire and Farid describes a photoelectrographic element including an acid photogenerating layer useful in electrography. Materials constructed according to that patent when exposed to relatively high intensity radiation of a particular wavelength become conductive in an electrographic sense. That is, they change their ability to hold an electrostatic charge. This characteristic is generally permanent until the material has been exposed to heat, after which the material can be reused. Other materials are known, for example, certain photocrosslinkable materials, which become less conductive when irradiated.

This persistent change in conductivity allows these materials to be used in electrography as xeroprinting masters. That is, after a persistent conductivity image has been created by exposure, it can be charged and toned to create a toner image and the toner image can be utilized, for example, by transferring to a receiving sheet. With a single conductivity image a number of prints can be made.

Once the conductivity image is formed, the materials are capable of high speed xeroprinting with excellent resolution and gradation. However, a problem with utilization of such materials in high quality and high quantity imaging is that actual formation of the original xeroprinting image requires substantial exposure. To do high quality prints, for example using a common laser printer, creation of a single conductivity image would take an inordinate amount of time.

U.S. Pat. No. 4,429,027 to Chambers et al suggests forming a mask electrophotographically or magnetically and transferring the mask to photosensitive layers for imagewise exposing of those layers in order to produce printing plates, printing circuits, solder masks, color prints, transparencies, etc.

U.S. Pat. No. 3,615,128 is representative of a number of references which show a single apparatus which provides a xeroprinting master electrophotographically and uses it to make prints.

DISCLOSURE OF THE INVENTION

It is the object of the invention to provide a method and apparatus for forming and using xeroprinting masters utilizing materials of the type described above, which process is feasible despite the slowness of those materials.

This and other objects are accomplished by using an electrostatically formed toner image as a mask for sensitizing the xeroprinting material.

According to a preferred embodiment, a method and apparatus is provided in which an electrostatic image is created and toned with a toner which is opaque to radiation of a given wavelength and intensity to create a primary toner image. The primary toner image is transferred, without fixing, to a master member having at least one layer of a material which persistently changes its conductivity in response to radiation of said given wavelength and intensity. The master material is exposed through the image to create a conductivity image defined by the toner image. The master member is then used as a xeroprinting master to form transferable toner images defined by the conductivity image.

According to a further preferred embodiment, the primary toner image is cleaned off the master member after exposure to radiation and before use to make images, thereby providing a planographic master which is a highly desirable master for high quality reproduction.

According to a further preferred embodiment, after the desired number of images have been formed using the master, it is subjected to heat and reused.

According to a further preferred embodiment, color prints can be made by forming at least two individual latent images and toning both images. The toner images are transferred to at least two master material surfaces, which may be on totally separate members or on different portions of the same member. These toned master surfaces are then exposed to appropriate radiation to create a conductivity image. The resulting master surfaces are charged and toned with toners of different colors to create toner images. The toner images are then transferred in registration to a substrate to create a multicolor toner image.

According to a further preferred embodiment, all of the above steps are accomplished by a single apparatus.

With this method and apparatus, a high quality, but low powered laser can be used with slow materials such as those described above, to productively produce masters and images therefrom.

BRIEF DESCRIPTION OF THE DRAWINGS

In the detailed description of the preferred embodiment of the invention presented below, reference is made to the accompanying drawings, in which.

DESCRIPTION OF PREFERRED EMBODIMENTS

Figures 1, 2, 3, 4:
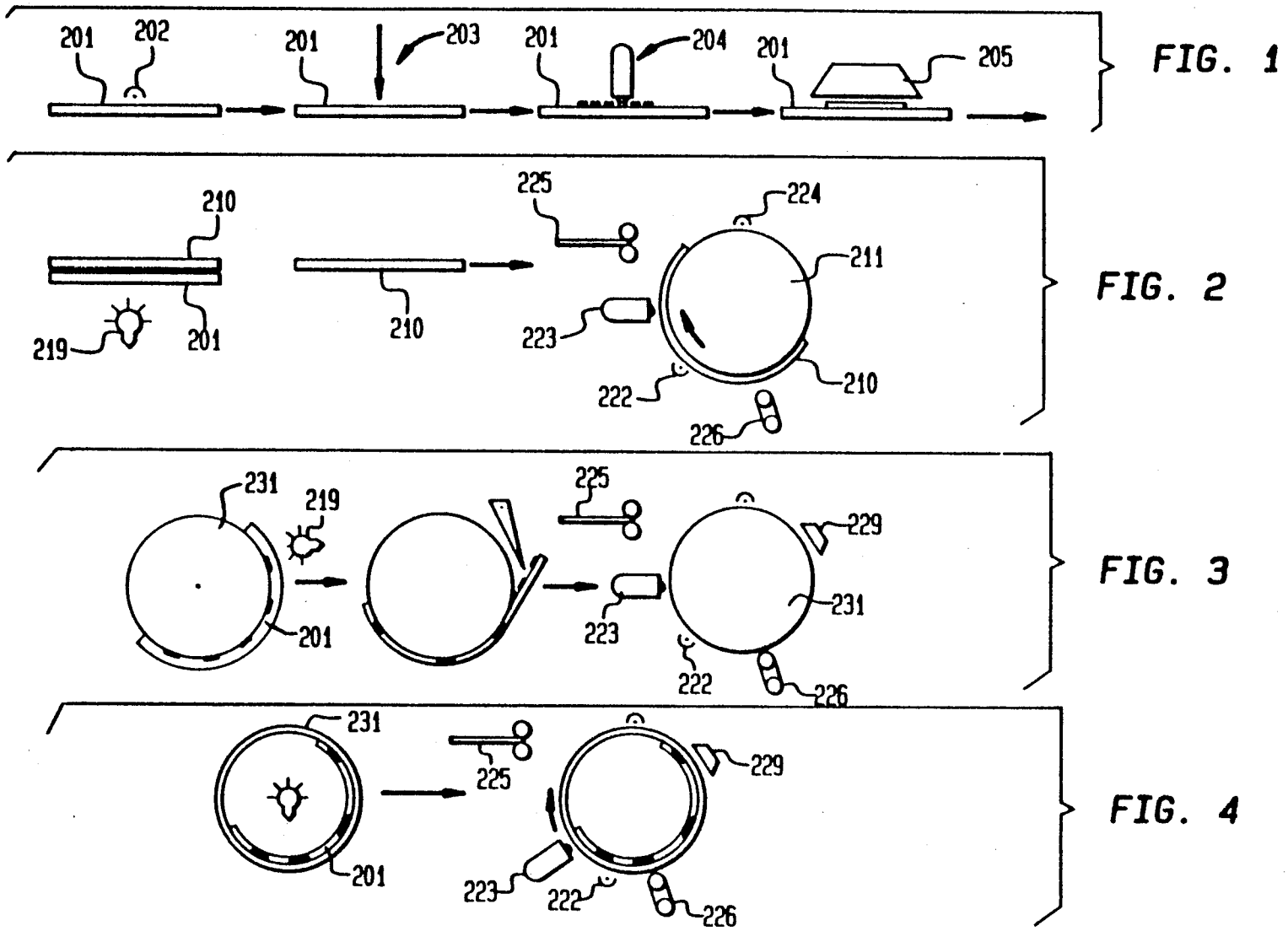
FIG. 1 is a schematic process diagram illustrating a method of making a mask.
FIGS. 2, 3 and 4 are schematic process diagrams illustrating alternative methods of utilizing the mask formed in FIG. 1 to create xeroprinting masters.

The method and apparatus described herein is particularly usable with materials shown in U.S. Pat. No. 4,661,429 to Molaire and Farid which disclosure is incorporated by reference herein. It is also useful with other materials which function similar to those materials. Materials which normally do not hold a charge in a particular condition, but do hold one after irradiation, can also be used.

FIGS. 1-4 illustrate a method of making xeroprinting masters utilizing acid photogenerating layers or such other similar materials. According to FIG. 1, a conventional transparent (to at least a given wavelength radiation) electrophotosensitive member 201 is charged by a charging device 202. The charged element 201 is exposed by an exposing device 203, for example a laser, to create a primary electrostatic image. The primary electrostatic image is toned by toning device 204 with a toner which is opaque to radiation of a given wavelength and intensity to create a primary toner image. The primary toner image is fused by a fusing device 205 to create an imagewise toner mask on a transparent medium. The mask 201 is placed in contact with a master member 210 having an acid photogenerating layer. With the fused primary toner image of the mask in intimate contact with the photogenerating layer, the sandwich is exposed to sensitizing radiation, for example, from a high intensity mercury vapor lamp 219 to form an image in the acid photogenerating layer which is conductive in the electrographic sense. That is, the portions of the layer which have not been exposed are able to hold a charge on their surface substantially better than the portions of the layer which have been exposed. These materials are capable of high resolution and multiple gradations.

The master member 210 is now positioned around a drum 211 and utilized in a xeroprinting process in which it is charged by a charging station 222 to create an electrostatic image in the portions that have not been exposed. This electrostatic image is toned by toning station 223 to create a toner image which toner image is transferred to a receiving sheet 225 at a transfer station 224. The process, of course, can be repeated as long as the conductivity image lasts. Best results are obtained if the master member is cleaned after each print by a cleaning station 226.

According to FIG. 3, the mask 201 can be used to form a conductivity image in an acid photogenerating layer coated or otherwise formed on the periphery of a drum 231.

In this approach, the mask 201 is wrapped around the drum 231 and exposed to source of radiation 219. The mask is removed and the drum used as a xeroprinting master.

As shown in FIG. 4, the mask could also be positioned on the inside of the drum, in which case it would not have to be removed. However, resolution would be subject to some loss from the separation between the mask and the ultimate xeroprinting surface.

The masters formed this way are smooth surface (planographic) masters which are advantageous in high quality work.

As seen in FIGS. 3 and 4, a heat generating station 229 is provided so that after the number of prints that are desired have been made, the acid photogenerating layer can be heated to regenerate it allowing it to be reused with a different mask having a different image.

According to a spohisticated version of FIGS. 1 and 2, elements 201 and 210 can be formed utilizing opposite sides of the same substrate. That is, a single substrate can include an electrophotosensitive layer on one side and an acid photogenerating layer on the other. The electrophotosensitive layer is first used to form the primary toner image and the acid photogenerating layer is exposed through the substrate with the toner image as a mask. The toner layer need not be fused, but if it is, care must be taken not to heat damage the acid photogenerating layer.

EXAMPLE 1

A conductive layer was solvent-coated through an extrusion hopper onto a poly(ethylene terephthalate) support. It consisted of 90 weight % cuprous iodide and 10 weight % poly(vinyl formal) in a solution of 3.8% solids in acetonitrile, coated to a dry thickness of 0.2 microns. Onto this, a layer of cellulose nitrate was coated from a solution of 5.5% solids in a 7:3 mixture of methanol and 1-butanol, to a dry thickness of 2 microns. A UV-sensitive layer was then coated onto the two base layers. The UV-sensitive layer consisted of 14 weight % di(4-t-butylphenyl)iodonium trifluoromethanesulfonate, 9 weight % 9,10-diethoxyanthracene, and 77 weight % "phenoxy resin" (bisphenol-A/epichlorohydrin adduct) from Aldrich Chemical Co. It was coated from a solution of 20% solids in tetrahydrofuran, to a dry thickness of about 10 microns.

The UV-sensitive layer was then used as a receiver in a conventional electrophotographic process to produce a xeroprinting master. To accomplish this, a conventional photoconductor was charged positively with a grid-controlled corona discharge unit, contact exposed to actinic radiation through a photographic negative in contact with the support side of the film. The photographic negative consisted of a halftone negative, silver halide, cyan separation of a pictorial scene. The latent image was then developed with black UV-absorbing toner and the toner transferred to the free surface of the UV-sensitive layer of the iodonium film. Next, a blanket exposure to UV-sensitizing radiation through the unfused toner mask was delivered to form a latent image in the acid photogenerating layer. The unfused toner was then removed from the iodonium film giving a flexible planographic master. The above process was repeated using magenta, yellow and black silver halide color separations to make four masters all exposed in register.

The four xeroprinting masters were charged with a grid-controlled corona discharge unit to a positive surface potential of about 500 volts, neg/pos developer with the corresponding color toner, and the toner sequentially transferred, in registration, to a coated paper receiver sheet, followed by fusing the 4-color image in an oven for approximately one minute at 120 degrees C. This process was repeated a number of times to make multiple high-quality (150 lines per inch) color prints.

In a separate experiment, toner was transferred to the UV-transparent support side of the film described above and oven fused at 120 degrees C. for about 15 seconds. A blanket exposure to UV-sensitizing radiation was delivered through the toner mask to activate the xeroprinting master. This master was corona charged and developed as described above to make a number of high-quality monochrome prints. A halftone test pattern was used to produce toned images having frequencies up to and including 150 lines per inch.

EXAMPLE 2

A xeroprinting master was made as in Example 1, except that in the UV-sensitive layer, the polymer binder was a polyester of 4,4'-(2-norbornylidene)diphenol with 60/40 ratio of terephthalic/azelaic acids. The UV-sensitive layer was coated from a solution of 10% solids in dichloromethane.

This film was tested by simulating a toner mask by exposure to actinic radiation through a silver halide separation mask in contact with the free surface of the UV-sensitive layer. Then the master was charged with a corona charger and the resulting surface potential measured with an electrometer. No prints were made with this master but the electrical measurements indicated that this film will result in high quality prints.

EXAMPLE 3

A xeroprinting master was made as in Example 1, except that the UV-sensitive layer consisted of 36 weight % tris(2-acryloyloxyethyl)-1,2,4-benzenetricarboxylate, 3 weight % 3-benzoyl-5,7-dipropoxycoumarin, 6 weight % ethyl 4-dimethylaminobenzoate, and 56 weight % of a polyester of 4,4'-(2-norbornylidene)diphenol with 60/40 ratio of terephthalic/azelaic acids. The UV-sensitive layer was coated from a solution of 10% solids in dichloromethane.

This film was tested by exposing four separate film samples to UV radiation through four different masks held in contact with the free surfaces of the UV-sensitive layers. The masks, which simulated toner masks, consisted of four positive, silver halide color separations corresponding to cyan, magenta, yellow and black. High-quality four color prints (150 lines per inch) were made using the same procedure described in Example 1.

Although the invention can be practiced using a variety of materials, including those disclosed in the Molaire et al patent mentioned above, monocolor xeroprinting at speeds in excess of 12 inches per second was accomplished using materials constructed and used according to Example I. The experimental work associated with Examples II and III demonstrate that those materials also can be used to practice the invention.

The process shown in FIGS. 1–4 has the advantage of using an extremely fine image creating source (the laser 203) to create an image of extremely fine resolution, for example, an image using halftones. However, it also permits the use of the high resolution photogenerating layer which is extremely slow by utilizing an intense radiation source 219 for exposure of the acid photogenerating layer according to a mask that has been made by the laser 203.

However, the process shown in FIGS. 1–4 requires a superposition of two sheet-like elements 201 and 210 or a sheet-like element 201 on a drum 231 and ultimately their separation, etc. Although this is a process that could be automated, a single apparatus that carried out the entire process would be complicated at best.

Figure 5:
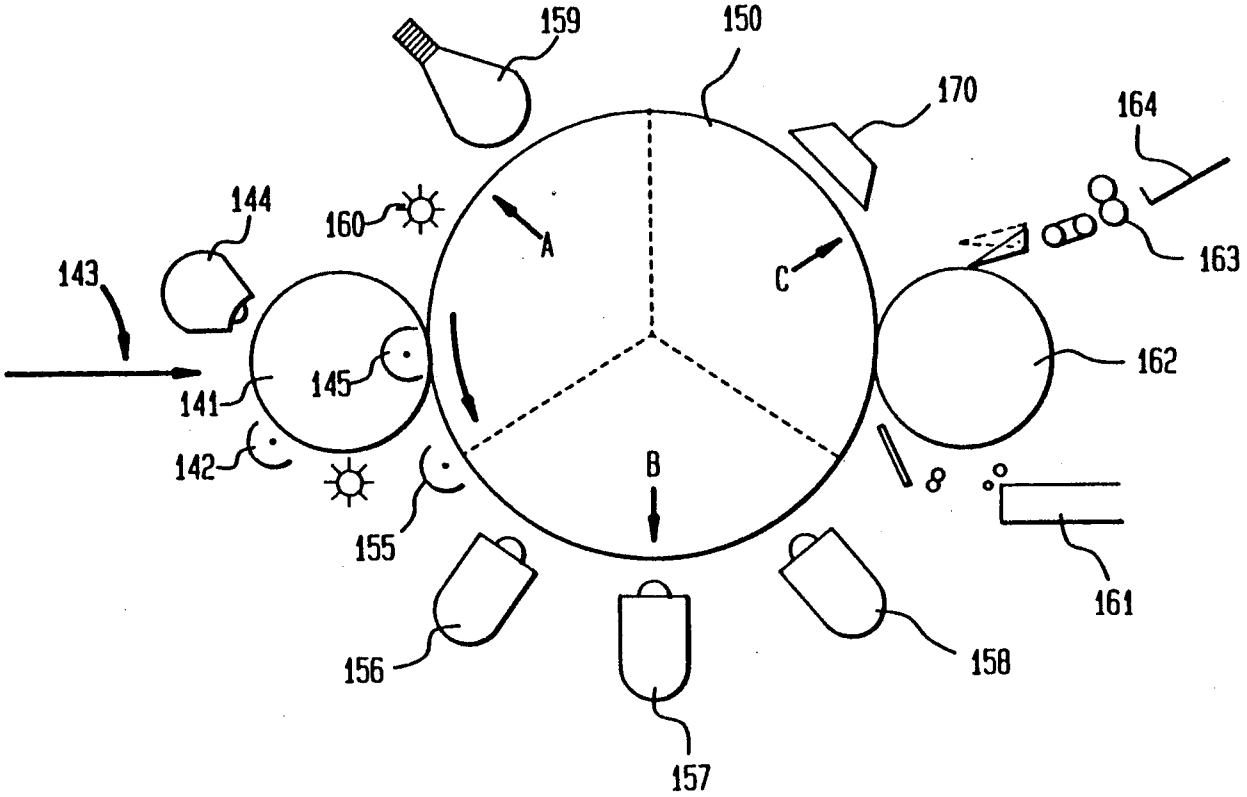
FIG. 5 is a side schematic view of an apparatus constructed according to the invention for both making a xeroprinting master and utilizing that master to make toner images.

According to FIG. 5 a preferred method is illustrated by a color apparatus in which the masters are both formed and utilized with a minimum of complexity. According to FIG. 5, a primary imaging member, for example, a photoelectrosensitive drum 141 is uniformly charged at a charging station 142, exposed by a laser or other high quality exposing device 143 and toned at a toning station 144 with toner that is opaque to radiation of the given intensity and wavelength, to create a primary toner image corresponding to the exposure. The primary toner image is transferred at a transfer station 145 to a master member 150. Master member 150 is in the form of a large drum having an acid photogenerating outer layer, which outer layer is divided into three surfaces A, B and C. Three consecutive color separation primary toner images are created on electrophotosensitive member 141 in three consecutive revolutions. These three primary toner images are transferred to surfaces A, B and C of master member 150.

Without fusing the primary toner images, the master member 150 is exposed to radiation from a radiation source 159 of an intensity and wavelength sufficient to sensitize the photogenerating layer in portions not covered by the toner images. After the master member 150 has been irradiated, the primary toner images can be cleaned by a cleaning station 160 producing a xeroprinting master which is substantially flat, i.e., planographic.

The apparatus may now be sped up and the master member 150 uniformly charged by a charging station 155. Each of the surfaces of the master member A, B and C are then toned by a toner of a different color from one of toner stations 156, 157 and 158 to create color toner images defined by the conductivity pattern in the acid photogenerating layer. The color toner images are transferred in registration to a receiving sheet fed from a receiving sheet supply 161 to a transfer drum 162 where the receiving sheet is held until three revolutions thereof. After all three toner images have been transferred to the receiving sheet, the receiving sheet is separated from the transfer drum 162 and fed to a fuser 163 and then to an output tray 164.

Thus, beginning with an ordinary low-energy, high quality laser input at 143 a duplicating device is made using a planographic xeroprinting master and making multicolor prints of high quality and at high production rates.

A heating device 170 is now used to regenerate the acid photogenerating layer so that it may be used again with new images from drum 141.

The master member 150 need not be a drum, but could be an endless web which provides certain machine configuration advantages. For example, the primary toner image could be readily transferred to the rear of the master member and the sensitive layer exposed through the rear as in FIG. 2 (but without separate sheet 201). This would eliminate the necessity of cleaning the master member before printing, although such re-cleaning would still be desirable if reuse is contemplated.

Figure 6:
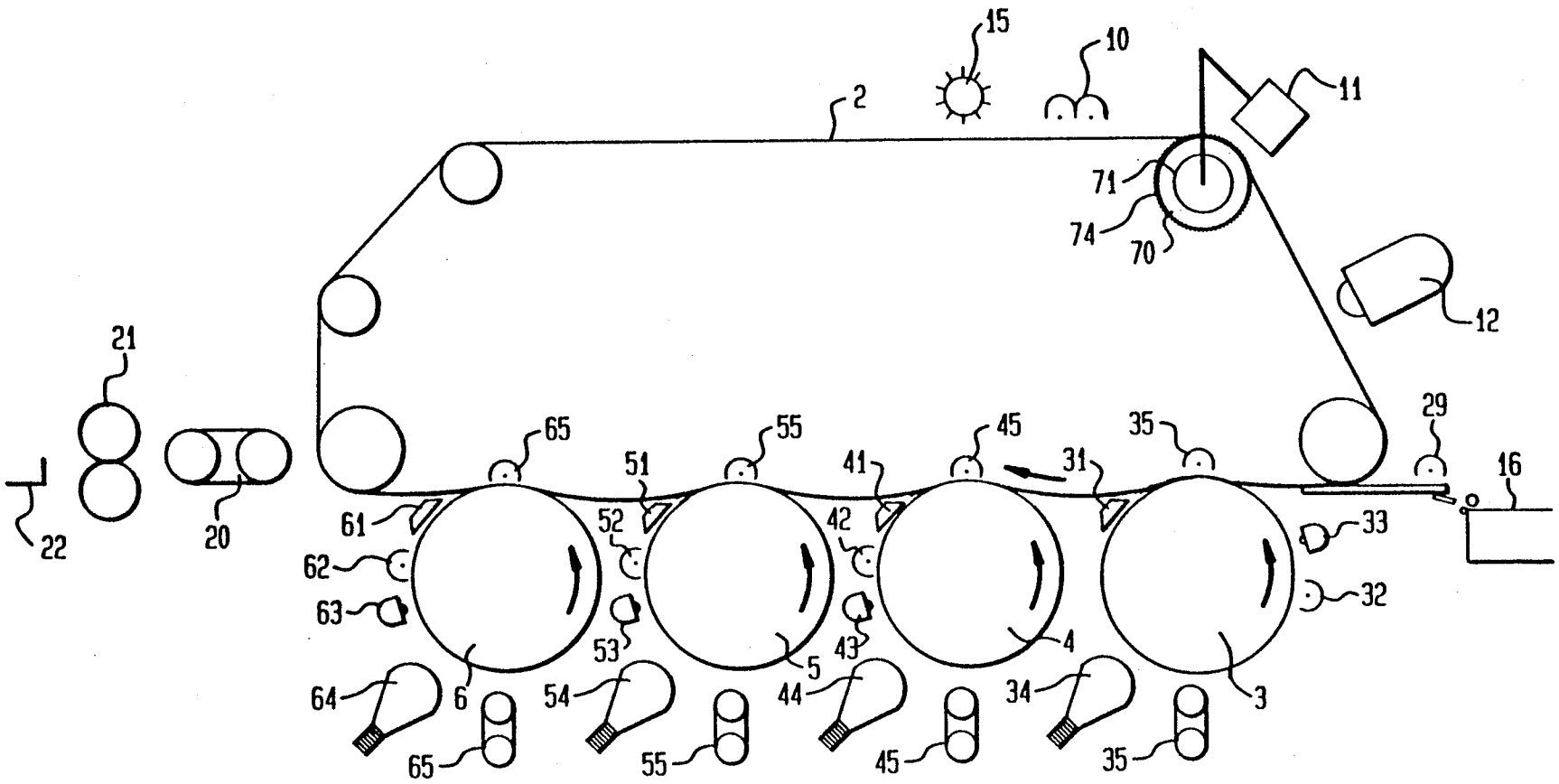
FIG. 6 is an alternative embodiment of the invention in which the masters are formed on separate drums.
Figure 8:
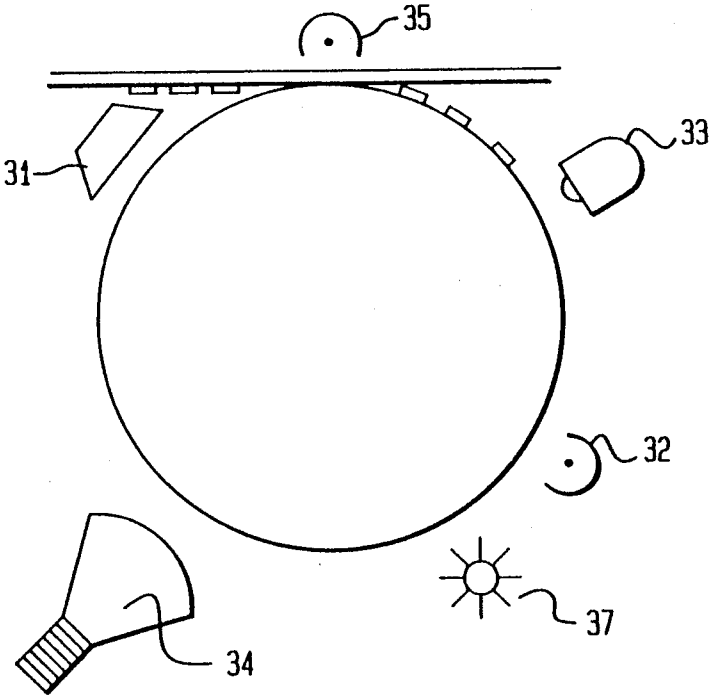
FIGS. 7 and 8 show a portion of the apparatus shown in FIG. 6 illustrating the formation of both the master and its use.
Figure 7:
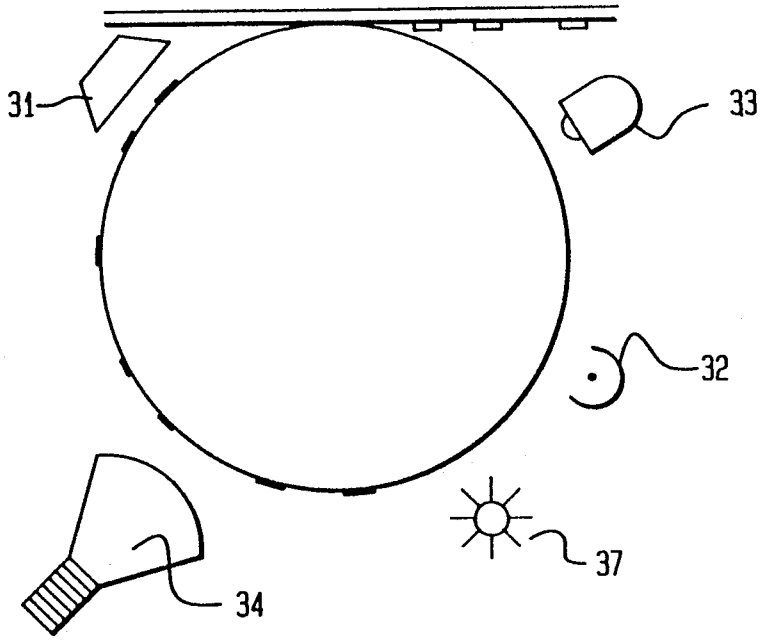

An alternative embodiment similar in many respects to the apparatus in FIG. 5 is shown in FIGS. 6–8. According to FIG. 6, an electrophotosensitive web 2 is uniformly charged at a charging station 10, and imagewise exposed at exposure station 11 to create an electrostatic image. The electrostatic image is toned at a toning station 12 to create a toner image and the toner image is transferred to one of drums 3, 4, 5 and 6. Four consecutive toner images are created in this manner and transferred by transfer chargers 35, 45, 55 and 65 to each of the drums 3, 4, 5 and 6. If a toner image is intended for drums 4, 5 or 6, upstream transfer chargers should be turned off or reversed as the image passes through.

Drums 3, 4, 5 and 6, as in the FIG. 5 embodiment, have an acid photogenerating layer on each of their peripheries. As seen best in FIG. 7, the toner images transferred to the periphery of drums 3, 4, 5 and 6 are used as a mask and are exposed by high intensity radiation sources 34, 44, 54 and 64 and then cleaned by cleaning stations 37, 47, 57 and 67 to create planographic xeroprinting masters similar to those in FIG. 5 except that the color separations are on 4 separate master members, drums 3, 4, 5 and 6.

As seen best in FIG. 8, the speed of the apparatus is now increased and each of the drums 3, 4, 5 and 6 is charged by charging stations 32, 42, 52 and 62 and toned by toning stations 33, 43, 53 and 63 with different colored toners to create different color toner images. As seen in FIG. 6 a series of receiving sheets is fed from a receiving sheet supply 16 into contact with web 2 where they are held by suitable means, for example, by electrostatic charge placed on the receiving sheet by a charging device 29. The receiving sheets are fed into transfer relation with the color toner images on the durms 3, 4, 5, and 6 which color images are transferred by transfer stations 35, 45, 55 and 65 in registration, to create a multicolor image. The receiving sheets are then fed by a transport device 20 to a fuser 21 and hence to an oupout tray 22.

Although this structure is somewhat more complicated then the FIG. 5 device, it dose have certain advantages. For example, since separate elements are used for each color, it is three (or four) times as fast as recirculating the transfer sheet three times with drum 162 in FIG. 5. Secondly, a set of perforations can be placed along an edge of web 2 and a sprocket 74 on a printhead roller 70 using an encoder 71 can be used to register exposures by exposure station 11. Sprockets on each of the drums can then use the same perforations to transfer the images forming the mask to the drums 3, 4, 5 and 6 and to transfer the color images back to the receiving sheets from the drum. Thus, registration is "automatically" managed. Each of the drums 3, 4, 5 and 6 has a heating device 31, 41, 51 and 61, respectively, to regenerate the material for new images.

Figure 9:
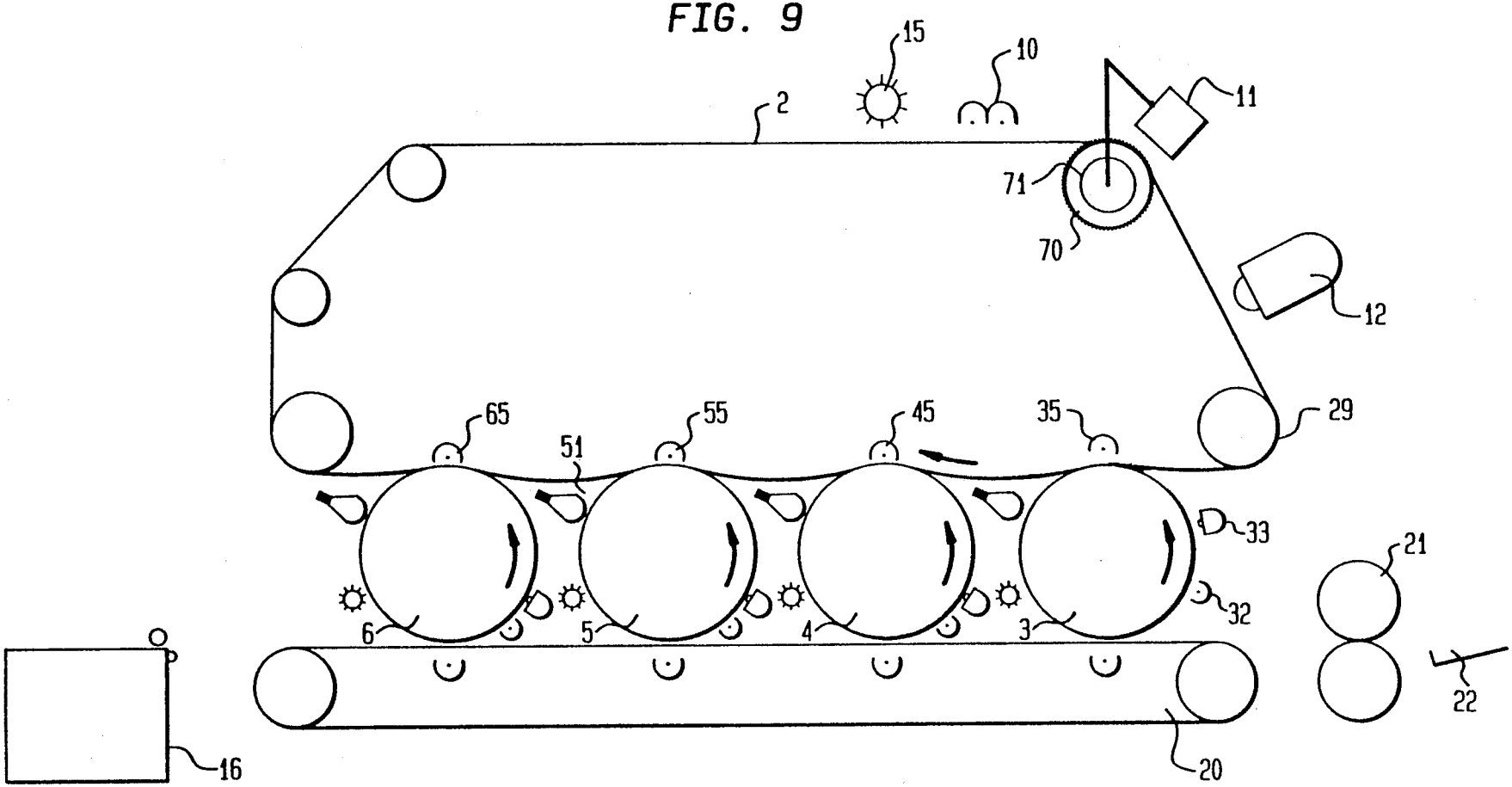
FIGS. 9 and 10 are side schematics similar to FIG. 6 illustrating alternative embodiments of apparatus for practicing the invention.

FIG. 9 shows a structure identical with FIG. 6, except that the receiving sheets receive the images from the drums 3, 4, 5 and 6 at a position remote on those drums from the original mask transfer stations 35, 45, 55 and 65. This assists somewhat in handling the receiving sheets, but loses the advantages of easy registration in FIG. 6.

Figure 10:
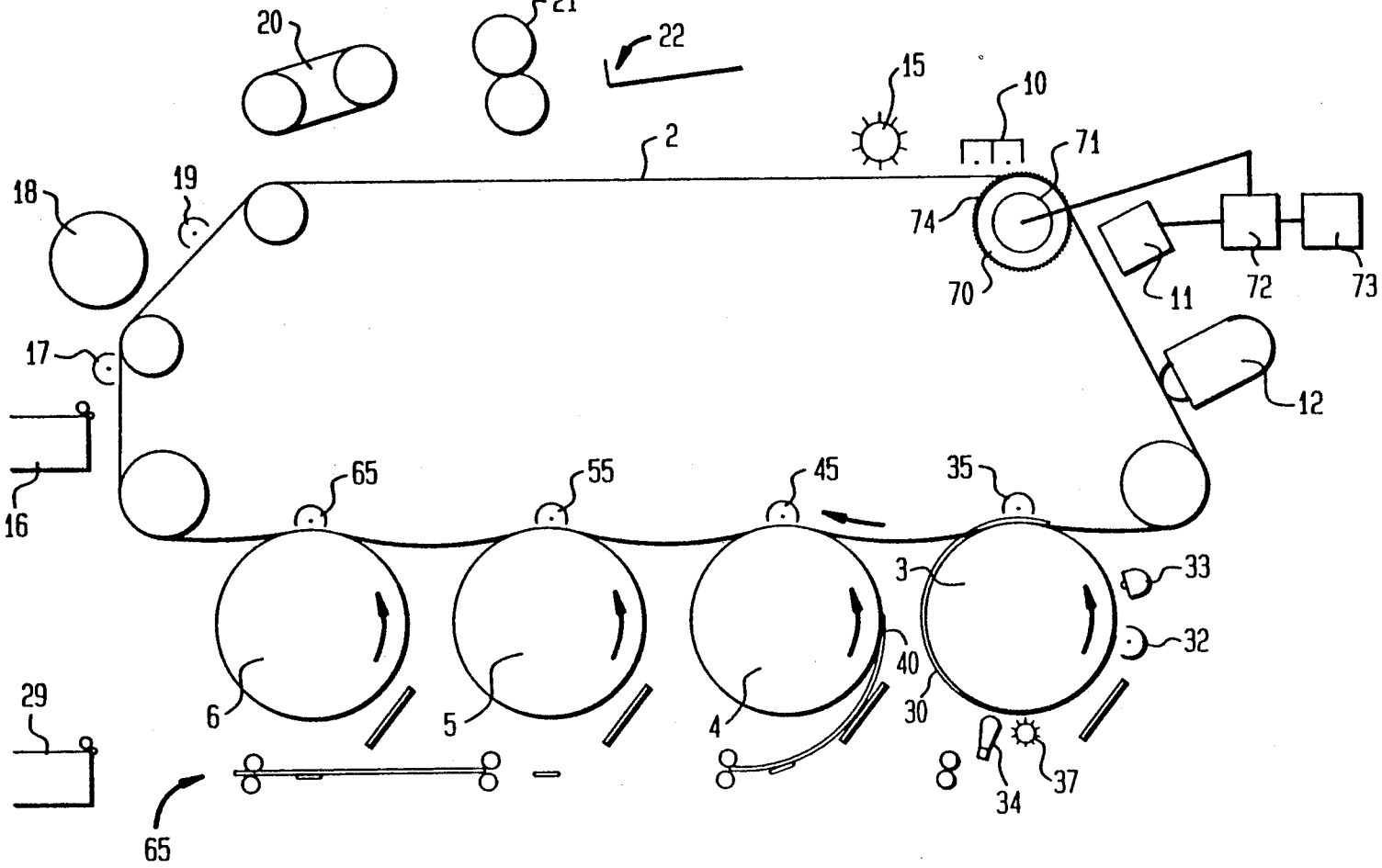

FIG. 10 shows a structure similar to that of FIG. 6, except that the color images are transferred directly back to web 2 to form the multicolor image and later transferred as a single multicolor image at either a first or a second transfer station 17 or 19. This structure has the advantage of easy handling of the receiving sheet and also of doing single-pass duplexing utilizing a turnover drum 18.

The structure shown in FIG. 10 also shows another feature in which the acid photogenerating layer is an outer layer of a sheet which is attached to durms 3, 4, 5 and 6. According to FIG. 10 the master sheets are fed from a master sheet supply 29 along a master feeding path 65 to be attached automatically to each of the drums for each set of images. With this structure, the heating device 31, 41, 51 and 61 are not necessary and fresh master material is used for each set of prints.

Figure 11:
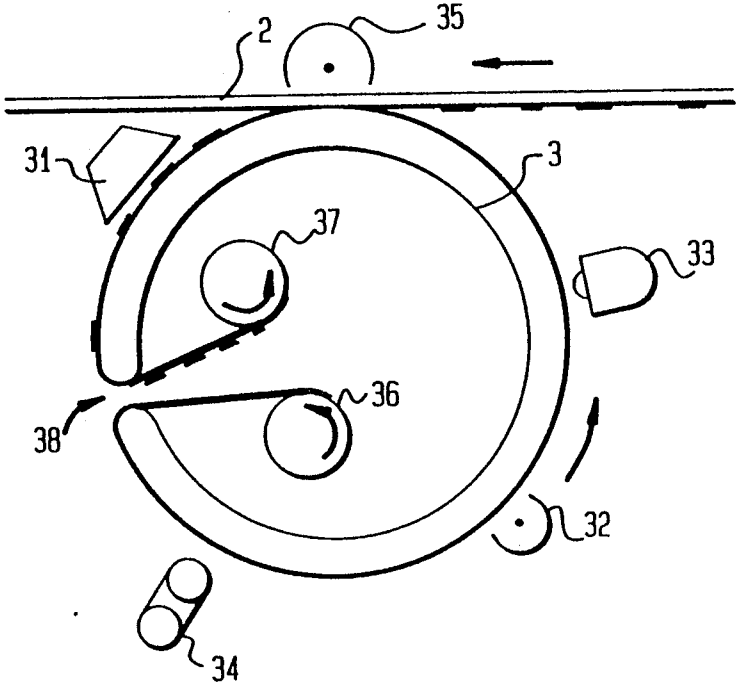
FIG. 11 is a side view similar to a portion of the FIG. 10 apparatus, illustrating an alternative approach to supplying master material.

FIG. 11 shows a variation of FIG. 10 in which each drum has a replaceable sheet with an acid photogenerating layer on its outside surface. For convenience, the material is fed from a continuous rool sheet supply 36 and taken up on a take-up roll 37 after use, thereby providing the process with fresh master materials for each set of images and using the convenience of a continuously fed web of material.

As illustrated by FIGS. 5–11 a single apparatus can be used to create xeroprinting masters with high resolution, relatively low output laser or other electronic device utilizing a material requiring very substantial exposure for original sensitization.

The invention has been described in detail with particular reference to a preferred embodiment thereof, but it will be understood that variations and modifications can be effected within the spirit and scope of the invention as described hereinabove and as defined in the appended claims.

We claim:

1. A method of creating a xeroprinting master, said method comprising:

creating an electrostatic image, toning said electrostatic image with a toner opaque to radiation of a given wavelength and intensity to form a primary toner image, transferring said toner image to a surface of a master member having at least one layer of a material which persistently changes its conductivity in response to radiation of said given wavelength and and intensity, without fixing said toner image to said master member, utilizing said primary toner image as a mask while exposing said master member to radiation of said given wavelength and intensity, and cleaning said toner image off said master member to form a planographic xeroprinting master.

2. The method according to claim 1 wherein said step of creating an electrostatic image includes imagewise exposing a charged electrophotosensitive member.

3. The method according to claim 2 wherein said step of exposing an electrophotosensitive member includes exposing said member with an electronic exposure means.

4. The method according to claim 3 wherein said electronic exposure means is a laser.

5. The method according to claim 1 wherein said transferring step includes transferring said toner image to a surface of said layer of material.

6. A method of creating a multicolor toner image, said method comprising:

creating a plurality of electrostatic images, toning said electrostatic images to create a plurality of primary toner images with a toner opaque to radiation of a given wavelength and intensity, transferring each primary toner image to a separate master, each of said masters having a layer of material which persistently changes its conductivity in response to radiation of said given wavelength and intensity, without fixing said toner images, exposing said masters having said toner images thereon to radiation of said wavelength and intensity to create a persistent conductivity image in each of said masters defined by said respective toner image, cleaning said toner images off said master surfaces to create planographic xeroprinting masters, charging each of said masters to create secondary electrostatic images defined by said conductivity images, toning said secondary electrostatic images with toners of different colors to create color toner images, and transferring said color toner images to a substrate in registration to create a multicolor toner image.

7. The method according to claim 6 including repeating the steps of charging, toning and transferring with respect to said master surfaces to create a plurality of multicolor toner images on a plurality of substrates from a single set of primary toner images.

8. The method according to claim 6 wherein said master surfaces are different portions of the same surface.

9. The method according to claim 8 wherein said same surface is the peripheral surface of a master drum.

10. The method according to claim 6 wherein said master surfaces are the peripheral surfaces of separate drums, respectively.

11. The method according to claim 6 including the step of heating said master surfaces after use as xeroprinting masters sufficiently to destroy said conductivity image to permit reuse of said master surfaces.

12. The method according to claim 6 wherein said step of creating electrostatic images includes exposing charged electrophotosensitive means with electronic exposure means.

* * * * *